US010981215B2

(12) United States Patent
Lustig et al.

(10) Patent No.: US 10,981,215 B2
(45) Date of Patent: Apr. 20, 2021

(54) METHOD FOR PRODUCING A MOULDING MATERIAL MIXTURE AND A MOULDED BODY THEREOF IN THE CASTING INDUSTRY AND KIT FOR USE IN THIS METHOD

(71) Applicant: HÜTTENES-ALBERTUS CHEMISCHE WERKE GESELLSCHAFT MIT BESCHRÄNKTER HAFTUNG, Düsseldorf (DE)

(72) Inventors: Christian Lustig, Düsseldorf (DE); Marcin Baldy, Hildesheim (DE); Edgar Müller, Langenhagen (DE); Lukas Mirko Reinold, Hannover (DE); Sabrina Maria Anderten, Isernhagen (DE); Maria Schweinefuß, Hannover (DE); René Vargovic, Wunstorf (DE)

(73) Assignee: HÜTTENES-ALBERTUS CHEMISCHE WERKE GESELLSCHAFT MIT BESCHRÄNKTER HAFTUNG, DÜSSELDORF (DE)

( * ) Notice: Subject to any disclaimer, the term of this patent is extended or adjusted under 35 U.S.C. 154(b) by 0 days.

(21) Appl. No.: 16/627,078

(22) PCT Filed: Jun. 28, 2018

(86) PCT No.: PCT/EP2018/067392
§ 371 (c)(1),
(2) Date: Dec. 27, 2019

(87) PCT Pub. No.: WO2019/002452
PCT Pub. Date: Jan. 3, 2019

(65) Prior Publication Data
US 2020/0130049 A1 Apr. 30, 2020

(30) Foreign Application Priority Data
Jun. 30, 2017 (DE) ..... 10 2017 114 628.8

(51) Int. Cl.
*B22C 1/18* (2006.01)

(52) U.S. Cl.
CPC ..... *B22C 1/188* (2013.01); *B22C 1/18* (2013.01); *B22C 1/186* (2013.01)

(58) Field of Classification Search
CPC ..... B22C 1/18; B22C 1/186; B22C 1/188
See application file for complete search history.

(56) References Cited

U.S. PATENT DOCUMENTS 4,078,029 A 3/1978 Yoshida
4,347,890 A 9/1982 Ailin-Pyzik et al.
(Continued)

FOREIGN PATENT DOCUMENTS

CN 102823912 12/2012
CN 104907485 9/2015
(Continued)

OTHER PUBLICATIONS

EPO machine translation CN 104907485 A (Year: 2015).*
(Continued)

*Primary Examiner* — Kevin E Yoon
(74) *Attorney, Agent, or Firm* — Duane Morris LLP; Gregory M Lefkowitz

(57) ABSTRACT

A description is given of a method for producing a molding material mixture or for producing a molding material mixture and a molding therefrom, preferably casting molds or cores, for use in the foundry industry, where the molding material mixture comprises a mold base material and a solution or dispersion comprising lithium-containing waterglass, comprising the following steps: (1) producing or providing a kit at least comprising as separate components:
(Continued)

Figure 1:
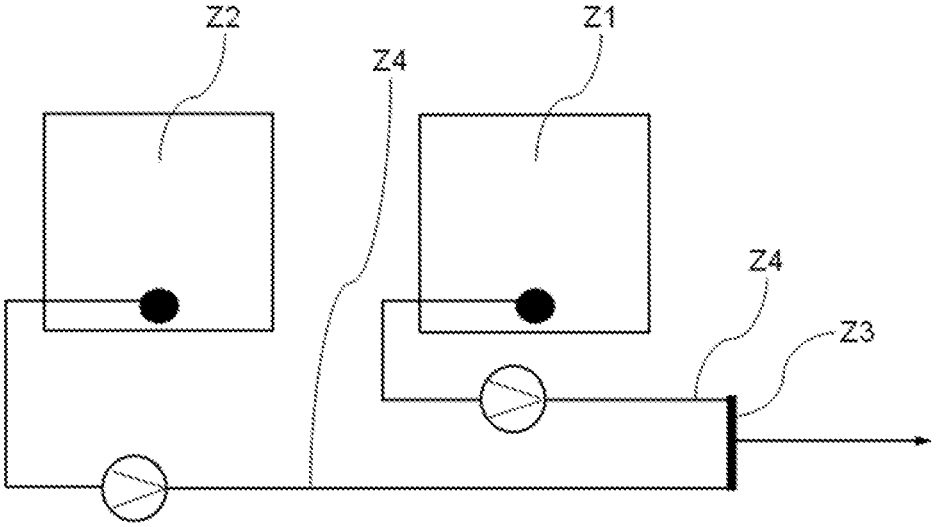

(K1) an aqueous solution or dispersion comprising waterglass and (K2a) a first waterglass-free solution or dispersion comprising lithium ions in solution in water, and also preferably (K2b) a second waterglass-free solution or dispersion, preferably comprising lithium ions in solution in water with a lower concentration than in component (K2a), and thereafter (2) producing a mixture of the mold base material with a fraction of component (K1) and with a fraction of component (K2a), and also optionally with a fraction of component (K2b). Further described is an aforementioned kit, more particularly for application in the method of the invention. An installation is specified as well for producing an intermediate solution or dispersion, comprising lithium-containing waterglass, for use in producing a molding material mixture or for producing a molding material mixture and a molding therefrom.

20 Claims, 2 Drawing Sheets

(56) References Cited

U.S. PATENT DOCUMENTS

| | | | | |
|---|---|---|---|---|
| 7,770,629 | B2 | 8/2010 | Weicker et al. | |
| 2015/0231691 | A1* | 8/2015 | Tanaka | B22C 9/12 164/7.1 |
| 2016/0059301 | A1 | 3/2016 | Muller et al. | |
| 2016/0136724 | A1* | 5/2016 | Deters | B22C 1/188 164/16 |
| 2016/0207099 | A1 | 7/2016 | Park | |
| 2016/0311012 | A1 | 10/2016 | Deters | |
| 2017/0320128 | A1* | 11/2017 | Deters | B32B 18/00 |

FOREIGN PATENT DOCUMENTS

| | | |
|---|---|---|
| DE | 102007045649 | 4/2009 |
| GB | 1532847 | 11/1978 |
| JP | 2001138006 | 5/2001 |
| WO | 2006024540 | 3/2006 |
| WO | 2008046651 | 4/2008 |
| WO | 2008046653 | 4/2008 |
| WO | 2013182186 | 12/2013 |
| WO | 2014059967 | 4/2014 |
| WO | 2014059968 | 4/2014 |
| WO | 2014059969 | 4/2014 |
| WO | 2014094721 | 6/2014 |
| WO | 2014094722 | 6/2014 |
| WO | 2014202042 | 12/2014 |
| WO | 2015058737 | 4/2015 |

OTHER PUBLICATIONS

Herrington et al., "Densities of aqueous lithium, sodium and potassium hydroxides from 25 to 75 degree C at 1 atm", Journal of Chemical and Engineering Data, 1986, vol. 31, No. 1, pp. 31-34.

Ongaratto et al., "Physical properties of potassium pyrophosphate and its use in osmotic evaporation", Chemical Engineering Research and Design, 2015, vol. 104, pp. 497-502.

* cited by examiner

METHOD FOR PRODUCING A MOULDING MATERIAL MIXTURE AND A MOULDED BODY THEREOF IN THE CASTING INDUSTRY AND KIT FOR USE IN THIS METHOD

CROSS-REFERENCE TO RELATED APPLICATIONS

This application is a § 371 national stage entry of International Application No. PCT/EP2018/067392, filed on Jun. 28, 2018, which claims priority to German Patent Application No. 102017114628.8, filed on Jun. 30, 2017, the entire contents of which are incorporated herein by reference.

The present invention relates to a method for producing a molding material mixture or for producing a molding material mixture and a molding therefrom, preferably a casting mold or a core, for use in the foundry industry, where the molding material mixture comprises a mold base material and a solution or dispersion comprising lithium-containing waterglass, comprising the steps of (1) producing or providing a kit at least comprising as separate components: (K1) an aqueous solution or dispersion comprising waterglass and (K2a) a first waterglass-free solution or dispersion comprising lithium ions in solution in water, and also preferably (K2b) a second waterglass-free solution or dispersion, preferably comprising lithium ions in solution in water with a lower concentration than in component (K2a), and thereafter (2) producing a mixture of the mold base material with a fraction of component (K1) and with a fraction of component (K2a), and also optionally with a fraction of component (K2b). The present invention further relates to an aforementioned kit, more particularly for application in the method of the invention. The present invention also relates to an installation for producing an intermediate solution or dispersion, comprising lithium-containing waterglass, for use in producing a molding material mixture or for producing a molding material mixture and a molding therefrom.

Casting molds are composed essentially of molds, or of molds and cores, which after they have been put together represent the shapes, in negative, of the casting that is to be produced. These cores and molds are moldings and consist generally of a refractory mold base material, such as silica sand, for example, and a suitable binder system, which gives the casting mold sufficient mechanical strength on its removal from the molding tool. The refractory mold base material is preferably particulate and in a free-flowing form, allowing it (after incorporation into a molding material mixture) to be introduced into a suitable hollow mold and compacted therein. The binder generates a firm cohesion between the particles of the mold base material, to give the casting mold the requisite mechanical stability.

Casting molds and the moldings contained therein (molds and optionally cores) have to fulfil various requirements. During the casting operation itself, they must initially have sufficient strength and temperature stability to be able to accommodate the liquid metal in the hollow space formed from one or more casting (part-)molds. After the start of the solidification process, the mechanical stability of the casting is then ensured by a solidified metal layer which develops along the walls of the casting mold.

Under the influence of the heat given off by the metal, the material of the casting mold is then to decompose in such a way that it loses its mechanical strength, thus with negation of the cohesion between individual particles of the refractory material. In the ideal case, the casting mold breaks down again into fine particles of the mold base material, which can readily be removed from the casting.

Moldings may be produced using both organic and inorganic binders, and these binders may be cured in each case by cold or hot methods. Cold methods are those which are carried out substantially without heating of the molding tool used for core production, generally at room temperature or at a temperature caused by any reaction. Curing is accomplished, for example, by passing a gas through the molding material mixture that is to be cured, with the triggering of a chemical reaction. In the case of hot methods, the molding material mixture after shaping, by the heated molding tool, for example, is heated to a temperature sufficiently high to drive out the solvent present in the binder and/or to initiate a chemical reaction through which the binder is cured.

A disadvantage of organic binders based on phenolic resin, however, independently of their composition, is that they decompose during casting and in so doing emit quantities, in some cases considerable quantities, of harmful substances, such as benzene, toluene and xylene, for example. Moreover, the casting of organic binders leads as a general rule to unwanted emissions of odor and smoke. With certain systems, unwanted emissions occur as early as during the production and/or storage of the casting molds.

For this reason, there is increasing preference for inorganic binders for use in the foundry industry; there is a high technical and economic interest in further improving the product properties of the foundry moldings produced accordingly, especially molds and cores.

Inorganic binders have been known for a long time, especially those based on waterglasses. In order to cure the waterglasses, there are three different methods in particular that are available: (i) passing a gas through, e.g., $CO_2$, air or a combination of both; (ii) adding liquid or solid curing agents, e.g., certain esters; and (iii) curing thermally, such as in the hot box method or by microwave treatment, for example.

The use of inorganic binder systems, however, is frequently associated with other, typical disadvantages:

Thus, with relative frequency, foundry moldings produced from inorganic binders have low strengths, unless suitable, special measures are taken. This becomes apparent with particular clarity immediately after the removal of the core or the casting mold, or the molding, from the tool. The strengths at this point in time ("hot strength" or "instantaneous strength") are particularly important for the reliable handling of the cores or molds during removal from the tool. Also important is a high "cold strength" (i.e., the strength after complete curing of the core or the casting mold), so that the desired casting can be produced as far as possible without casting defects.

Document DE-A 2652421 describes binders which consist of a solution of a mixture of potassium silicate and/or sodium silicate with lithium silicate and which are suitable, for example, as binders for foundry cores.

Document U.S. Pat. No. 4,347,890 describes a method for binding a particulate material. The method involves mixing the particulate material with a solution containing lithium ions (according to example 1, this is an aqueous solution of lithium silicate or lithium waterglass), mixing sodium silicate into this mixture, and lastly molding the mixture and curing it by means of microwave radiation.

Document WO 2006/024540A2 includes in its description a method for producing casting molds, where a waterglass-based binder is admixed with a fraction of a particulate metal oxide.

Document WO 2014/202042A1 describes lithium-containing molding material mixtures based on an inorganic binder for producing molds and cores for metal casting. Described therein, for example, is the possibility, through defined addition of lithium-containing compounds to inorganic binders based on waterglass, of improving the storage stability of casting molds or cores produced using such binders. At the same time, said cores or casting molds are said to have a high level of strength.

In the industrial practice it has emerged that liquid, inorganic binders with a fraction of lithium ions, especially those based on waterglass, can become unstable too rapidly, depending on the concentration of lithium ions therein and on the storage conditions (especially the storage temperature). Over just a few days in the course of storage, for example, instable binders of this kind form turbidities, as a result, for example, of formation of gels, and/or show precipitation of solids, such as of carbonates and/or silicates, and hence become inhomogeneous or heterogeneous. It has likewise emerged that such turbidities in or precipitations of solids from liquid, lithium-containing, inorganic binders are a disadvantage in the processing of these binders and in particular may give rise to problems in pumps, filters and/or metering units, or else problems at the stage of further processing. A high level of lithium ions and also increased temperatures, accordingly, promote the disadvantageous tendency of these liquid binders toward instability.

A certain increased lithium ion content in inorganic binder systems based on waterglass, accordingly, is advantageous for achieving a high stability, especially a high storage stability, of cores or molds in the foundry industry. On the other hand, however, such aforementioned binders with high lithium ion contents exhibit comparatively poor storage integrity.

It was therefore a primary object of the present invention to provide a method for producing a molding material mixture or for producing a molding material mixture and a molding (such as a mold or a core), more particularly a storage-stable molding, for the foundry industry that allows the use of an inorganic binder, especially waterglass, with a variably adjustable—including high—concentration of lithium ions, depending on external parameters, and, in so doing, alleviating or avoiding the aforesaid disadvantages of the prior art.

A further object of the present invention was to provide a readily manageable kit which is suitable for producing a liquid, lithium-containing, inorganic binder with variably adjustable lithium ion concentration, where the binder ought to be stable under the individual storage conditions at any rate prior to its use as intended.

An additional specific object of the present invention was to provide an installation, such as a production plant, which allows the aforesaid method to be implemented on the industrial fabrication scale as well.

The invention, and also inventively preferred combinations of preferred parameters, properties and/or constituents of the present invention, are defined in the appended claims. Preferred aspects of the present invention are also specified or defined in the description hereinafter and also in the examples.

It has now surprisingly been found that the primary object and also further objects and/or component objects of the present invention are achieved by means of a method of the invention for producing a molding material mixture or for producing a molding material mixture and a molding therefrom, preferably a storage-stable molding, where the molding material mixture comprises:

(M1) a mold base material and (M2) a solution or dispersion comprising lithium-containing waterglass, which possesses a molar $SiO_2/M_2O$ modulus in the range from 1.6 to 3.5, preferably in the range from 1.8 to 3.0, and in which the molar fraction of the $Li_2O$ within $M_2O$ is in the range from 0.05 to 0.60, preferably in the range from 0.1 to 0.4, comprising the following steps:

(1) producing or providing a kit at least comprising the following separate components:

(K1) an aqueous solution or dispersion comprising waterglass, where the $SiO_2$ content is in the range from 20 to 34 wt %, preferably in the range from 25 to 34 wt %, based on the total mass of the solution or dispersion, and/or where the molar $SiO_2/M_2O$ modulus is greater than the molar modulus of the lithium-containing waterglass in the molding material mixture being produced, and (K2a) a first waterglass-free solution or dispersion comprising lithium ions in solution in water, where the concentration of the lithium ions is in the range from 0.3 to 5.3 mol/L, preferably in the range from 1.0 to 5.0 mol/L and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and thereafter (2) producing a mixture of the mold base material (M1) with a fraction of component (K1) and also with a fraction of component (K2a), where the solution or dispersion (M2) is formed by mixing together the components of the kit that are used, where $M_2O$ denotes in each case the total amount of lithium oxide, sodium oxide and potassium oxide.

Preference here is given to the embodiment of the method of the invention as specified above where in component (K1) the molar $SiO_2/M_2O$ modulus is greater than the molar modulus of the lithium-containing waterglass in the molding material mixture being produced.

Particularly preferred is the embodiment of the method of the invention as specified above where component (K1) takes the form of an aqueous solution or dispersion comprising waterglass, where the $S_1O_2$ content is in the range from 20 to 34 wt %, preferably in the range from 25 to 34 wt %, based on the total mass of the solution or dispersion, and where the molar $SiO_2/M_2O$ modulus is greater than the molar modulus of the lithium-containing waterglass in the molding material mixture being produced.

Preference is given to a method of the invention as described above (more particularly a method of the invention designated as being preferred in this text) wherein the aqueous solution or dispersion comprising waterglass (K1) has a pH in the range from 10.0 to 13.0, preferably in the range from 11.0 to 12.5.

Preference is given at the same time to a method of the invention as described above (more particularly a method of the invention which is designated as preferred in this text) in which the first waterglass-free solution or dispersion comprising lithium ions in solution in water (K2a) has a pH in the range from 8.0 to 14.0, preferably in the range from 11.5 to 13.5.

In the context of the present invention, the following designations each have the definitions specified below:

"$SiO_2$" denotes the molar amount of silicon in the aqueous solution or dispersion, calculated according to the empirical formula $SiO_2$, independently of whether the silicon on which this calculation is based is actually present as $SiO_2$ in the method of the invention (or the kit of the invention).

"M" denotes an alkali metal selected from the group consisting of lithium, sodium and potassium.

"$M_2O$" denotes the total molar amount of alkali metal in the aqueous solution or dispersion, calculated according to the empirical formula $M_2O$. "$Li_2O$", accordingly, denotes the molar amount of lithium, calculated according to the empirical formula $Li_2O$. These calculation figures are in each case independent of whether the alkali metals on which the calculation is based are actually present in the form "$M_2O$" in the method of the invention (or the kit of the invention).

In the above-specified method of the invention, component (K1) comprises an aqueous (water-containing) solution or dispersion comprising waterglass. Waterglass in the context of the present invention is alkali metal waterglass known per se, which comprises vitreous, i.e., amorphous, water-soluble sodium silicates, potassium silicates and—in small concentrations which do not affect the stability, especially the storage stability, of the waterglass—lithium silicates, solidified from a melt, or respective aqueous solutions of the aforesaid sodium, potassium and lithium silicates.

The mold base material (M1) is preferably a particulate refractory mold base material. "Refractory" in the present text, in agreement with the customary understanding of the skilled person, denotes compositions, materials and minerals which are able at least for a short time to withstand the temperature exposure involved in the casting and/or solidification of a metal melt—aluminum, for example. Examples of suitable mold base materials are silica sand, zircon or chromium ore sand, olivine, vermiculite, bauxite, chamotte, and synthetic mold base materials. The mold base material (M1) may be a mixture of two or more (preferably particulate, refractory) substances.

The molding produced by the above-specified method of the invention is preferably a molding for use in the foundry industry, more preferably a mold or a core. A particular advantage of the method of the invention is the possibility of using a binder system, needed for the production of moldings with high strength and high storage stability, that has a high and/or variably adjustable lithium ion content, and which is not subject, or subject to a much smaller extent, to the temporal restrictions on the storage durations of known binders with a high (but generally not modifiable and/or intended for modification) lithium ion content. Accordingly, by the method of the invention, it is possible to produce moldings which have a high strength and can be stored for a relatively long time, preferably a period in the range from one day up to 2 weeks, without detraction from their advantageous properties to an extent relevant for practice. Accordingly, after their production and up until their use in a casting procedure, the moldings produced by the method of the invention can be easily handled without deforming or fragmenting and/or can be stored over a relatively long period, thus enabling production from stock. A particular advantage is the property possessed by the moldings produced by the method of the invention of retaining their high strength even at elevated humidity and remaining stable, so that the moldings produced are distinguished by high storage stability even in humid or hot and humid climate zones. For changing weathering conditions (seasons) in temperate climate zones as well, however, the method of the invention brings advantages.

In the method of the invention specified above, component (K2a) comprises lithium ions in solution in water. Where component (K2a) is a solution, the lithium ions are a constituent of the solution. Where component (K2a) is a dispersion, the lithium ions are present, preferably in solution, at least predominantly and preferably entirely in the continuous (liquid, aqueous) phase. Further to the lithium ions, component (K2a) preferably comprises sodium ions and/or potassium ions as further alkali metal ions. Component (K2a) may comprise lithium ions and potassium ions, or component (K2a) may comprise lithium ions and sodium ions, or component (K2a) may comprise lithium ions, sodium ions and potassium ions. The maximum total concentration of the lithium, sodium and potassium ions in component (K2a) is dependent on factors including the nature and the proportion of the alkali metal ions present. The skilled person knows how to establish the requisite and/or preferred concentrations of alkali metal ions under the prevailing and/or desired conditions.

Particularly preferred is a method of the invention as described above (more particularly a method referred to hereinafter as preferred) wherein the kit produced or provided in step (1) additionally comprises the following separate component:

(K2b) a second waterglass-free solution or dispersion comprising alkali metal ions in solution in water, preferably comprising lithium ions in solution in water, where the concentration of the lithium ions is lower than in component (K2a) and is preferably in the range from 0 to 5.0 mol/L, more preferably in the range from 0 to 2.0 mol/L, and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and preferably the total concentration of the lithium, sodium and potassium ions differs by not more than 20%, preferably by not more than 10%, from the total concentration of the lithium, sodium and potassium ions in component (K2a), and wherein step (2) comprises the following:

(2) producing a mixture of the mold base material (M1) with a fraction of component (K1) and also with a fraction of component (K2a) and optionally a fraction of component (K2b), where the solution or dispersion (M2) is formed by mixing together the components of the kit that are used.

Preferred is a method of the invention as described above (more particularly a method of the invention which is referred to in this text as preferred) wherein the second waterglass-free solution or dispersion comprising lithium ions in solution in water (K2b) has a pH in the range from 8.0 to 14.0, preferably in the range from 11.5 to 13.5. With regard to preferred pH values for the solutions or dispersions (K1) and/or (K2a), reference may be made to the disclosure earlier on above.

Particularly preferred, therefore, is a method of the invention for producing a molding material mixture or for producing a molding material mixture and a molding therefrom, preferably a storage-stable molding, where the molding material mixture comprises:

(M1) a mold base material and (M2) a solution or dispersion comprising lithium-containing waterglass, which possesses a molar $SiO_2/M_2O$ modulus in the range from 1.6 to 3.5, preferably in the range from 1.8 to 3.0, and in which the molar fraction of the Li2O within $M_2O$ is in the range from 0.05 to 0.60, preferably in the range from 0.1 to 0.4, comprising the following steps:

(1) producing or providing a kit at least comprising the following separate components:

(K1) an aqueous solution or dispersion comprising waterglass, where the $SiO_2$ content is in the range from 20 to 34 wt %, preferably in the range from 25 to 34 wt %, based on the total mass of the solution or dispersion, and/or where the molar $SiO_2/M_2O$ modulus is greater than the molar modulus of the lithium-containing waterglass in the molding material mixture being produced, (K2a) a first waterglass-free solution or dispersion comprising lithium ions in solution in water, where the concentration of the lithium ions is in the range from 0.3 to 5.3 mol/L, preferably in the range from 1.0 to 5.0 mol/L, and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and (K2b) a second waterglass-free solution or dispersion comprising alkali metal ions in solution in water, preferably comprising lithium ions in solution in water, where the concentration of the lithium ions is lower than in component (K2a) and is preferably in the range from 0 to 5.0 mol/L, more preferably in the range from 0 to 2.0 mol/L, and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and preferably the total concentration of the lithium, sodium and potassium ions differs by not more than 20%, preferably by not more than 10%, from the total concentration of the lithium, sodium and potassium ions in component (K2a), and thereafter (2) producing a mixture of the mold base material (M1) with a fraction of component (K1) and also with a fraction of component (K2a) and optionally a fraction of component (K2b), where the solution or dispersion (M2) is formed by mixing together the components of the kit that are used, where $M_2O$ denotes in each case the total amount of lithium oxide, sodium oxide and potassium oxide.

In the particularly preferred method of the invention indicated above, component (K2b) comprises, in solution in water, alkali metal ions, preferably lithium ions, sodium ions and/or potassium ions. Component (K2b) preferably comprises lithium ions. The alkali metal ions in component (K2b) may comprise only lithium ions or only sodium ions or only potassium ions. Component (K2b), as alkali metal ions, may also comprise lithium ions and sodium ions, or it may comprise lithium ions and potassium ions, or it may comprise sodium ions and potassium ions. In one preferred embodiment of the method of the invention or of a method preferred in accordance with the invention, the concentration of the lithium ions in component (K2b) is lower than in component (K2a) and is preferably in the range from 0.1 to 5.0 mol/L, more preferably in the range from 0.1 to 2.0 mol/L.

The effect of the preferred embodiment of the method of the invention wherein the total concentration of the lithium, sodium and potassium ions in component (K2b) is different by not more than 20%, preferably by not more than 10%, from the total concentration of the lithium, sodium and potassium ions in component (K2a) is that when the kit constituents (K1), (K2a) and (K2b) are mixed together (in the absence or presence of the mold base material (M1)), the total concentration of the lithium, sodium and potassium ions in the resultant solution or dispersion (M2) is the same as or at least similar to the total concentration of the lithium, sodium and potassium ions in a solution or dispersion (M2) formed only by mixing together the kit constituents (K1) and (K2a). Accordingly, when the kit constituent (K2b) (which has a lower lithium ion concentration than the kit constituent (K2a)) is employed in the method according to the invention, the lithium ion concentration of the resultant solution or dispersion (M2) is influenced, preferably lowered, in comparison to a solution or dispersion (M2) which has been produced by mixing together only the kit constituents (K1) and (K2a) and under otherwise identical conditions.

The kit constituent (K2b) may therefore be used advantageously in order to lower the lithium ion content of a solution or dispersion (M2) in a readily meterable and well-controllable manner, without, in a manner relevant to practice, influencing or modifying the other properties of the resultant solution or dispersion (M2), such as its molar $SiO_2/M_2O$ modulus or its total alkali metal ion concentration, in any way different to that which would take place by addition of a corresponding amount of the kit constituent (K2a). As a result of adding component (K2b), therefore, it is possible to reduce the addition of (K2a) while ensuring that the binder (M2) being produced has the same modulus and the same concentration as before with the higher fraction of (K2a).

In step (2) of the preferred method of the invention indicated above, a mixture is produced from the mold base material (M1) with a fraction of component (K1) and also with a fraction of component (K2a), and optionally with a fraction of component (K2b). "Optionally" here and below means that—depending on the individual requirements—a fraction of component (K2b) is used or is not used. As a result, a desired lithium ion concentration can be established individually and flexibly in the solution or dispersion (M2). Therefore, when establishing the lithium ion content or concentration of the solution or dispersion (M2), it is possible to take account of the ambient conditions (especially the humidity) and to add in each case only the amount of lithium ions as is necessary to optimize the production operation under the prevailing environmental conditions. One of the measures made possible by this flexible means of metering lithium ions when producing the solution or dispersion (M2) is a saving in raw materials costs for the expensive lithium compounds which are present in the kit constituents (K2a) and preferably also (K2b).

The mixture identified above can be produced by first mixing a fraction of component (K1) with the mold base material (M1) and subsequently mixing this premix with a fraction of component (K2a) and optionally with a fraction of component (K2b) to give a molding material mixture; the amount of lithium ions in the molding material mixture is established preferably by selection of component (K2a) and optionally component (K2b) each in an appropriate amount and lithium ion concentration. The mixing of the premix with a fraction of component (K2a) and optionally a fraction of component (K2b) also results in the formation of the solution or dispersion (M2).

The mixture can also be produced by first mixing the mold base material (M1) with a fraction of component (K2a) and optionally with a fraction of component (K2b) and subsequently mixing this premix with a fraction of component (K1) to give a molding material mixture; the amount of lithium ions in the molding material mixture is established preferably by selection of component (K2a) and optionally component (K2b) each in an appropriate amount and lithium ion concentration. The mixing of the premix with a fraction of component (K1) also results in the formation of the solution or dispersion (M2).

The mixture in step (2) of the method of the invention is preferably produced by first mixing a fraction of component (K1) with a fraction of component (K2a) and optionally with a fraction of component (K2b) to give a solution or dispersion (M2), and preferably the amount of lithium ions in the solution or dispersion (M2) is established by selection of component (K2a) and optionally component (K2b) each in an appropriate amount and lithium ion concentration. This separately produced solution or dispersion (M2) is then mixed with the mold base material (M1).

With particular preference the mixture in step (2) of the method of the invention is produced by first mixing a fraction of component (K2a) with a fraction of component (K2b) to form a "(K2a)+(K2b) premix" and then mixing this "(K2a)+(K2b) premix" with a fraction of component (K1) to give a solution or dispersion (M2), and the amount of lithium ions in the solution or dispersion (M2) is established preferably by selection of component (K2a) and component (K2b) each in an appropriate amount and lithium ion concentration.

Particularly preferred is a method of the invention for producing a molding material mixture or for producing a molding material mixture and a molding therefrom, preferably a storage-stable molding, where the molding material mixture comprises:

(M1) a mold base material and (M2) a solution or dispersion comprising lithium-containing waterglass, which possesses a molar $SiO_2/M_2O$ modulus in the range from 1.6 to 3.5, preferably in the range from 1.8 to 3.0, and in which the molar fraction of the Li2O within $M_2O$ is in the range from 0.05 to 0.60, preferably in the range from 0.1 to 0.4, comprising the following steps:

(1) producing or providing a kit at least comprising the following separate components:

(K1) an aqueous solution or dispersion comprising waterglass, where the $SiO_2$ content is in the range from 20 to 34 wt %, preferably in the range from 25 to 34 wt %, based on the total mass of the solution or dispersion, and/or where the molar $SiO_2/M_2O$ modulus is greater than the molar modulus of the lithium-containing waterglass in the molding material mixture being produced, (K2a) a first waterglass-free solution or dispersion comprising lithium ions in solution in water, where the concentration of the lithium ions is in the range from 0.3 to 5.3 mol/L, preferably in the range from 1.0 to 5.0 mol/L, and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and (K2b) a second waterglass-free solution or dispersion comprising lithium ions in solution in water, where the concentration of the lithium ions is lower than in component (K2a) and is preferably in the range from 0.1 to 5.0 mol/L, more preferably in the range from 0.1 to 2.0 mol/L, and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and preferably the total concentration of the lithium, sodium and potassium ions differs by not more than 20%, preferably by not more than 10%, from the total concentration of the lithium, sodium and potassium ions in component (K2a), and thereafter (2) producing a mixture of the mold base material (M1) with a fraction of component (K1) and also with a fraction of component (K2a) and with a fraction of component (K2b), where the solution or dispersion (M2) is formed by mixing together the components of the kit that are used, where $M_2O$ denotes in each case the total amount of lithium oxide, sodium oxide and potassium oxide.

Preference is given to a method of the invention or preferred in accordance with the invention, as indicated above or below, where in step (2) a solution or dispersion (M2) is formed first, in the absence of the mold base material, by mixing together the components of the kit that are used, and thereafter forming a mixture of the fraction or of a fraction of the mold base material (M1) with a fraction or the total amount of the resultant solution or dispersion (M2).

The components of the kit that are used are mixed together in a conventional way, preferably by means of an agitator mechanism or a mixing pipe, preferably a static mixing pipe.

The preferred method variant (also referred to below as "preliminary mixing of the kit constituents used") is especially advantageous because in this way it is possible for a premixed solution or dispersion (M2) to be prepared and then stored for a certain period, and to be adapted (or adaptable) to the ambient conditions preferably in such a way that instabilities do not result in precipitation (through precipitation of constituents from the solution or dispersion (M2)) and/or gelling. A premixed solution or dispersion (M2) of this kind may also be used in order to feed an automated or semi-automated production facility, so that the premixed solution or dispersion (M2) can be employed directly in a serial or predominantly serial industrial production process.

In-house investigations have found that a solution or dispersion (M2) produced as described above (premixed) can be stored—depending on the concentration and the storage conditions (e.g., temperature, stirring)—for up to several weeks, preferably up to 6 days, more preferably up to 3 days, without observable quality defects in the case of the solution or dispersion (M2) (in this regard, see below) or in the production of moldings using the stored solution or dispersion (M2), or in castings produced using the moldings produced with the stored solution or dispersion (M2).

It has emerged, moreover, that the separate (unmixed) components (K1), (K2a) and (K2b) remain stable over long periods, of more than a year, for example, and on storage remain unchanged or substantially unchanged and without practice-relevant quality detractions. A particular service provided by the present invention is therefore that waterglass-containing binders with high lithium ion concentration can now be made available in a demand-dependent manner for manufacture or production and can be employed rapidly, with a solution to the problem associated with the ready perishability and/or poor (short) storability of waterglass-containing binders of this kind with a high lithium ion concentration. The solution or dispersion (M2) produced (premixed) is stored preferably in closed containers.

In one particularly advantageous embodiment of the method of the invention, preference is given to a method as described above (particularly a method identified above or hereinafter as being preferred, preferably a method variant comprising the preliminary mixing of the kit constituents used) where the solution or dispersion (M2) produced contains no visible precipitates or gel fractions before the mixture with the mold base material (M1) is formed.

In-house trials have shown that the testing of the solution or dispersion (M2) produced for visible precipitates or gel fractions can be a simple inspection. In practice, therefore, the skilled person is able with sufficient reliability to recognize and decide whether the solution or dispersion (M2) has the required consistency or the quality required for further processing in the method of the invention, step (2). The said testing takes place preferably directly before a mixture is produced from the mold base material (M1) with the solution or dispersion (M2) produced, for the purpose of producing a molding material mixture. Where the test indicates that the solution or dispersion (M2) produced does not have the quality or consistency required for further processing, it is not used in further method steps, but is instead replaced preferably by a different solution or dispersion (M2) which does have the quality or consistency required for further processing. This design of the method allows rapid, simple and cost-effective quality control to be carried out in the manufacturing operation.

Preference is also given to a method of the invention as described above (especially a method identified above or below as being preferred, preferably a method variant comprising the preliminary mixing of the kit constituents used) where the components of the kit that are used are mixed together to form the solution or dispersion (M2) in a mixing facility, where preferably the mixing facility is a metering vessel or a mixing pipe, and more preferably a mixing pipe, very preferably a static mixing pipe.

This mixing facility may be a separate, for instance self-standing, mixing facility which is operated alongside and/or independently of at least partial serial manufacture of moldings ("batch operation"). Batch operation of this kind has the advantage that different batches of solutions or dispersions (M2) can be produced at any time and that their quality can be verified in each case. The mixing facility may also be a constituent of at least partial serial manufacture of moldings, for instance a constituent of an installation for at least partial serial manufacture of moldings ("continuous or semi-continuous operation"). Continuous or semi-continuous operation of this kind is suitable especially for the (industrially preferred) at least partial serial manufacture of moldings in relatively large numbers, such as manufacture on stock, for example. The mixing facility may also be a stock vessel in which at least one of the components (K1), (K2a) and/or (K2b) is stored or is held for use in an at least partial serial manufacture of moldings, and in which, as and when necessary, at least one complementary component (K1), (K2a) and optionally (K2b) is mixed in.

The above-stated mixing facility is preferably a metering vessel or a mixing pipe. A preferred mixing pipe is a static mixing pipe. A static mixing pipe is a mixing facility particularly preferred for use in the method of the invention. Suitable by way of example for use in the method of the invention are static mixing pipes from Sulzer, of the "ComparX™" or "SMX™ plus" type.

Preferred metering vessels are selected from the group consisting of Intermediate Bulk Containers (also identified as IBC containers or Schütz containers), drums and canisters. A preferred mixing facility for the aforesaid continuous or semi-continuous operation is a mixing pipe, preferably a static mixing pipe. However, an aforesaid metering vessel can also be used in continuous or semi-continuous operation.

Preference is also given to a method of the invention as described above (especially a method identified above or below as being preferred, preferably a method variant comprising the preliminary mixing of the kit constituents used) where the fraction or the total amount of the solution or dispersion (M2) formed, before the forming of a mixture with the or a fraction of the mold base material (M1), is stored for a period of not more than 7 days, preferably of not more than 3 days, more preferably of not more than 2 days, in the mixing facility. This counteracts the development of precipitates (through precipitation of constituents from the solution or dispersion (M2)) and/or gels.

Where the mixing facility (mixing pipe or metering vessel) is a constituent of an at least partial serial manufacture of moldings, there is generally no provision for prolonged storage of the solution or dispersion (M2) produced, such as for storage over a period of more than 2 days, preferably over a period of more than one day. Instead, in these cases, there is provision customarily for a relatively short storage for preferably not more than one day, so that at least partial serial manufacture or a production process of this kind is possible.

Prolonged storage (preferably for the above-defined period of not more than seven days) of the solution or dispersion (M2) produced may, however, be preferable in cases where the mixing facility also serves as a stock container for a solution or dispersion (M2) produced, prior to mixing with the mold base material (M1).

Preference is given to a method of the invention as described above (especially a method identified above or below as being preferred) for producing a molding material mixture and a molding therefrom, comprising the additional steps of establishing, determining or estimating one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, and controlling the fractions to be used of components (K2a) and (K2b) as a function of the established, determined or estimated parameter or parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding.

Especially preferred here is a combination of a parameter from the group composed of ambient temperature when producing the molding and temperature during the storage of the molding, with a parameter from the group composed of relative humidity when producing the molding and relative humidity during the storage of the molding.

The "relative humidity" here—in agreement with the usual understanding of the skilled person—indicates the actual water fraction in the air at a given temperature, based on the physical maximum of the water content of the air at that temperature.

The absolute humidity—in agreement with the usual understanding of a skilled person—is determined from temperature and relative humidity. A higher absolute humidity is achieved if, for example, the temperature rises while the relative humidity remains the same, or if the relative humidity rises at a constant temperature.

Factors which make the establishment of a comparatively higher concentration of lithium ions appear sensible in the method of the invention are, in particular, a higher absolute humidity during the production and/or storage of a molding, and/or a longer storage duration of the molding.

Preferably, therefore, a higher or lower concentration of lithium ions is established in the solution or dispersion (M2) according to the parameter value established, determined or estimated. A higher concentration of lithium ions may preferably be established by increasing the fraction of component (K2a) in the solution or dispersion (M2), for instance by raising the fraction of admixing of component (K2a) and/or (where component (K2b) is used) by reducing the fraction of admixture of component (K2b). According to the requirements, component (K2b) may also be omitted entirely.

Accordingly, preference is given to a method of the invention as described above (especially a method identified above or below as being preferred) where the method is embodied as an at least partial serial, preferably predominantly serial, manufacture of a number of moldings, where, in the case of increase or expected increase in one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, the fractions that are used of component (K2a) are increased for the fabrication of the moldings and/or the molar fraction of the $Li_2O$ within $M_2O$ in the solution or dispersion (M2) is increased for the fabrication of the moldings.

Conversely it is of course advantageous to design the method of the invention in such a way that, in the case of a decrease or a reduction, or an expected decrease or expected reduction, in one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, the fractions of component (K2a) used for the manufacture of the moldings are reduced and/or the optionally employed fractions of component (K2b) for the manufacture of the moldings are increased and/or the molar fraction of the $Li_2O$ within $M_2O$ in the solution or dispersion (M2) is reduced for the fabrication of the moldings.

Preference is likewise given to a method of the invention as described above (especially a method identified above or below as being preferred) where, for establishing, determining or estimating the one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, a data capture facility or data processing facility is provided and to control the fractions that are to be used of components (K2a) and (K2b) as a function of the established, determined or estimated parameter or parameters, a control facility is provided, where preferably, between the data capture facility or the data processing facility and the control facility, a data connection is set up to transfer parameter data.

The aforesaid data capture facility or data processing facility is preferably an instrument for the capturing of climatic conditions, or a data logger. The aforesaid control facility is preferably an automated mixing facility.

This aforesaid embodiment of the method of the invention has the advantage that the admixing or metering of the kit constituents can be carried out with automation or at least partial automation as a function of the influencing parameters in an industrial manufacturing operation.

Preference is also given to a method of the invention as described above (especially a method identified above or below as being preferred) where, during production of the molding material mixture, one or more constituents are additionally added which are selected from the group consisting of:

(M3) particulate, amorphous silicon dioxide; barium sulfate; carbohydrates; phosphorus compounds; surface-active compounds; oxidic boron compounds; metal oxides; lubricants, esters and release agents.

Particulate amorphous silicon dioxide ("$SiO_2$") used is preferably particulate amorphous silicon dioxide in customary purity, i.e., with customary impurities and secondary constituents. Preference is given to using, for the purposes of the present invention, particulate amorphous silicon dioxide having a silicon dioxide content of at least 85 wt %, more preferably of at least 90 wt % and very preferably of at least 95 wt %. The term "particulate" here refers to a solid powder (including dusts) or else a granular material which is preferably pourable and hence also sievable. The d90, based on number of particles, of the particulate amorphous silicon dioxide is preferably less than 100 μm, more preferably less than 45 μm. This means that 90% of the particles of the particulate amorphous silicon dioxide present in the molding material mixture are preferably smaller than 100 μm, more preferably smaller than 45 μm. The d90 is determined preferably by micrographs taken with a scanning electron microscope. Particulate amorphous silicon dioxide used may be either synthetically produced or naturally occurring types. The latter are known from document DE 102007045649, for example, but are not preferred, since they frequently include not inconsiderable crystalline fractions and are therefore classed as carcinogenic. Synthetically produced particulate amorphous silicon dioxide is produced by a deliberately conducted chemical reaction. Examples of such are the flame hydrolysis of silicon tetrachloride and the reduction of silica sand with coke, in an arc oven, in the production of silicon and ferrosilicon. The amorphous $SiO_2$ produced by these two methods is also referred to as fumed $SiO_2$. A further example of synthetically produced particulate amorphous silicon dioxide is silicon dioxide obtained by thermal decomposition of $ZrSiO_4$ to $ZrO_2$ and $SiO_2$, and partial or substantially complete removal of the $ZrO_2$, as described in document DE 102012020509, for example. Preference is given to the use, as or in constituent (M3) according to the method of the invention, of synthetically produced particulate amorphous $SiO_2$, more preferably fumed particulate amorphous $SiO_2$ and/or $SiO_2$ from the thermal decomposition of $ZrSiO_4$. Particulate amorphous silicon dioxide suitable for the purposes of the present invention is also specified, for example, in documents DE 102004042535A1, DE 102012020510A1 and DE 102012020511A1. The particulate amorphous silicon dioxide is used preferably in an amount in the range from 0.3 to 3.0 wt %, based on the total weight (the total mass) of the molding material mixture (sum total of the weights or masses of constituents (M1), (M2) and—where present—(M3) and any further constituents, respectively).

Barium sulfate used may be synthetically produced or natural barium sulfate, i.e., in the form of minerals containing barium sulfate, such as heavy spar or baryte. Synthetically produced barium sulfate (also called "blanc fixe") is produced, for example, by means of a precipitation reaction. For this purpose, it is usual to dissolve readily soluble barium compounds (barium salts) in water. Subsequently, by addition of readily soluble sulfate salts (such as sodium sulfate, for example) or else sulfuric acid, the low-solubility barium sulfate is precipitated. The precipitated barium sulfate is isolated by filtration, dried and optionally ground. Barium sulfate suitable for the purposes of the present invention is also specified in document DE 102012104934, for example. The barium sulfate is used preferably in an amount in the range from 0.02 to 5.0 wt %, based on the total weight (the total mass) of the molding material mixture (sum total of the weights or masses of constituents (M1), (M2) and—where present—(M3) and any further constituents, respectively).

The carbohydrates which can be used as or in constituent (M3) in the method of the invention described above are preferably selected from the group consisting of oligosaccharides and polysaccharides, preferably selected from the group consisting of cellulose, starch and dextrin. The stated carbohydrates may be used individually or in combination with one another. Carbohydrates suitable for the purposes of the present invention are, for example, also specified in document EP 2104580. The carbohydrate or carbohydrates are preferably used in an amount in the range from 0.01 to 10.0 wt %, based on the total weight (the total mass) of the molding material mixture (sum total of the weights or masses of constituents (M1), (M2) and—where present—(M3) and any further constituents, respectively).

The phosphorus compounds which can be used as or in constituent (M3) in the method of the invention described above are preferably selected from the group consisting of organic phosphates and inorganic phosphates, preferably selected from the group consisting of inorganic alkali metal phosphates. The stated phosphorus compounds may be used individually or in combination with one another. Phosphorus compounds suitable for the purposes of the present invention are also, for example, specified in document EP 2097192. The phosphorus compound or compounds are preferably used in an amount in the range from 0.05 to 1.0 wt %, based on the total weight (the total mass) of the molding material mixture (sum total of the weights or masses of constituents (M1), (M2) and—where present—(M3) and any further constituents, respectively).

The surface-active compounds which can be used as or in constituent (M3) in the method of the invention described above are preferably selected from the group consisting of anionic surfactants, nonionic surfactants, cationic surfactants and amphoteric surfactants. The stated surfactants can be used individually or in combination with one another. Surfactants suitable for the purposes of the present invention are also specified, for example, in document DE 102007051850. The surface-active compound or compounds are preferably used in an amount in the range from 0.001 to 1.0 wt %, based on the total weight (the total mass) of the molding material mixture (sum total of the weights or masses of constituents (M1), (M2) and—where present—(M3) and any further constituents, respectively). The above-stated surface-active compounds may also be used as a constituent of component (K1).

The oxidic boron compounds which can be used as or in constituent (M3) in the method of the invention described above are preferably selected from the group consisting of borates, boric acids, boric anhydrides, borosilicates, borophosphates and borophosphosilicates, more preferably selected from the group consisting of alkali metal borate and alkaline earth metal borate, the oxidic boron compound preferably containing no organic groups. The stated oxidic boron compounds can be used individually or in combination with one another. Oxidic boron compounds suitable for the purposes of the present invention are also specified, for example, in document DE 102013111626. The oxidic boron compound or compounds are preferably used in an amount in the range from 0.001 to 1.0 wt %, based on the total weight (the total mass) of the molding material mixture (sum total of the weights or masses of constituents (M1), (M2) and—where present—(M3) and any further constituents, respectively). The above-stated oxidic boron compounds may also be used as a constituent of component (K1).

The metal oxides which can be used as or in constituent (M3) in the method of the invention described above comprise preferably particulate mixed metal oxides, preferably comprising oxides of aluminum and/or oxides of zirconium. Preferred metal oxides comprise particulate aluminum oxide, preferably in the alpha phase, and/or particulate aluminum/silicon mixed oxide without sheet silicate structure. The stated metal oxides may be used individually or in combination with one another. Metal oxides suitable for the purposes of the present invention are also specified, for example, in documents DE 102012113074 and DE 102012113073. The metal oxide or oxides are used preferably in an amount in the range from 0.05 to 8.0 wt %, based on the total weight (the total mass) of the molding material mixture (sum total of the weights or masses of constituents (M1), (M2) and—where present—(M3) and any further constituents, respectively).

The lubricants which can be used as or in constituent (M3) in the method of the invention described above are preferably selected from graphite and/or molybdenum(IV) sulfide. The stated lubricants may be used individually or in combination with one another. Lubricants suitable for the purposes of the present invention are also specified, for example, in document WO 2014/202042. The lubricant or lubricants are used preferably in an amount in the range from 0.01 to 0.2 wt %, based on the total weight (the total mass) of the molding material mixture (sum total of the weights or masses of constituents (M1), (M2) and—where present—(M3) and any further constituents, respectively).

The silanes which can be used as or in constituent (M3) in the method of the invention described above are preferably selected from the group consisting of aminosilanes, epoxysilanes, mercaptosilanes, hydroxysilanes and ureidosilanes. The aforesaid silanes may also act as lubricants. The stated silanes may be used individually or in combination with one another. Silanes suitable for the purposes of the present invention are also specified, for example, in document WO 2014/202042. The silane or silanes are used preferably in an amount in the range from 0.1 to 2.0 wt %, based on the total weight (the total mass) of the molding material mixture (sum total of the weights or masses of constituents (M1), (M2) and—where present—(M3) and any further constituents, respectively).

The release agents which can be used as or in constituent (M3) in the method of the invention described above are preferably selected from the group consisting of calcium stearate, fatty acid esters, waxes, natural resins and alkyd resins. The stated release agents may be used individually or in combination with one another. Release agents suitable for the purposes of the present invention are also specified, for example, in document EP 1802409. The release agent or agents are used preferably in an amount in the range from 0.1 to 2.0 wt %, based on the total weight (the total mass) of the molding material mixture (sum total of the weights or masses of constituents (M1), (M2) and—where present—(M3) and any further constituents, respectively).

The esters (one or more) which can be used as or in constituent (M3) in the method of the invention described above are preferably selected from the group consisting of the intramolecular or intermolecular reaction products of an alcohol and an acid, the alcohol being selected from the group consisting of C1-C8 monoalcohols, C1-C8 dialcohols, preferably C2-C8 dialcohols, and C1-C8 trialcohols, preferably C3-C8 trialcohols, preferably selected from the group consisting of ethylene glycol, 1,2-propanediol and glycerol, and the acid being selected from the group consisting of organic C1-C8 monocarboxylic acids, preferably organic C2-C8 monocarboxylic acids, organic C2-C8 dicarboxylic acids, organic C2-C8 tricarboxylic acids, preferably organic C3-C8 tricarboxylic acids, and inorganic acids, preferably selected from the group consisting of formic acid, acetic acid, propionic acid, lactic acid, oxalic acid, succinic acid, malonic acid, phosphoric acid, sulfuric acid, boric acid and carbonic acid, with at least one of the esters preferably being propylene carbonate or γ-butyrolactone. The aforesaid esters may be used individually or in combination with one another. The ester or esters are used preferably in an amount in the range of up to 0.4 wt %, preferably in an amount in the range from 0.01 wt % to 0.4 wt %, based on the total weight (the total mass) of the molding material mixture (sum total of the weights or masses of constituents (M1), (M2) and—where present—(M3) and any further constituents, respectively).

The aforesaid one or more constituents (M3)—particulate amorphous silicon dioxide; barium sulfate; carbohydrates; phosphorus compounds; surface-active compounds; oxidic boron compounds; metal oxides; lubricants, esters and release agents—may be used individually or in combination with one another. The one or more constituents (M3) may for example be added individually or jointly, preferably jointly, to the mold base material (M1) and be mixed with the latter, and subsequently, this premix of the components (M1) and (M3) may be admixed with the produced (premixed) solution or dispersion (M2) and mixed therewith (preferably homogeneously). It is also possible for the premix of the components (M1) and (M3) to be admixed with the further components (K1), (K2a) and optionally (K2b) individually, and the resulting molding material mixture may then be mixed (preferably homogeneously). Water-soluble constituents (M3), preferably the aforesaid surface-active compounds and/or oxidic boron compounds, may be added, for example, individually or jointly to the component (K1), and/or may be part of the component (K1).

Also preferred, moreover, is a method of the invention as described above (especially a method designated above or below as being preferred) where the first waterglass-free solution or dispersion (K2a) and optionally (where present or used) the second waterglass-free solution or dispersion (K2b) each comprise lithium hydroxide in solution in water.

It is preferred, accordingly, for the first waterglass-free solution or dispersion, comprising lithium ions in solution in water (K2a), to comprise lithium hydroxide in solution in water. Where the second waterglass-free solution or dispersion, comprising alkali metal ions in solution in water (K2b), comprises lithium ions, it is accordingly also preferred for the second waterglass-free solution or dispersion to comprise lithium hydroxide in solution in water. Lithium hydroxide, especially lithium hydroxide monohydrate, has a solubility in water that is suitable for the purposes of the present invention. In in-house trials, furthermore, it has emerged that solutions and/or dispersions (K2a) and/or (K2b) having outstandingly suitable storage stability can be produced for the purposes of the present invention with lithium hydroxide, especially lithium hydroxide monohydrate. Components (K2a) and/or (K2b) containing lithium ions are therefore preferably produced using lithium hydroxide, more preferably lithium hydroxide monohydrate.

Also preferred is a method of the invention as described above (especially a method of the invention referred to in this text as being preferred), where the aqueous solution or dispersion comprising waterglass (K1) has a pH in the range from 10.0 to 13.0, preferably in the range from 11.0 to 12.5, and/or (preferably "and")

the first waterglass-free solution or dispersion comprising lithium ions in solution in water (K2a) has a pH in the range from 8.0 to 14.0, preferably in the range from 11.5 to 13.5, and/or (preferably "and" where component (K2b) is present)

the second waterglass-free solution or dispersion comprising lithium ions in solution in water (K2b) (where used) has a pH in the range from 8.0 to 14.0, preferably in the range from 11.5 to 13.5.

The invention also relates to a kit for producing a solution or dispersion comprising lithium-containing waterglass, at least comprising the following separate components:

(K1) an aqueous solution or dispersion comprising waterglass, where the $SiO_2$ content is in the range from 20 to 34 wt %, preferably in the range from 25 to 34 wt %, based on the total mass of the solution or dispersion, and/or where the molar $SiO_2/M_2O$ modulus is greater than the molar modulus of the lithium-containing waterglass being produced, and (K2a) a first waterglass-free solution or dispersion comprising lithium ions in solution in water, where the concentration of the lithium ions is in the range from 0.3 to 5.3 mol/L, preferably in the range from 1.0 to 5.0 mol/L and the total concentration of the lithium, sodium and potassium ions is in the range from 0.3 to 28.0 mol/L, preferably in the range from 0.3 to 20.0 mol/L, more preferably in the range from 1.0 to 10.0 mol/L.

Particularly preferred is a kit of the invention as described above, additionally comprising as a further separate component:

(K2b) a second waterglass-free solution or dispersion comprising alkali metal ions in solution in water, where the concentration of the lithium ions is lower than in component (K2a) and is preferably in the range from 0 to 5.0 mol/L, more preferably in the range from 0 to 2.0 mol/L, and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and preferably the total concentration of the lithium, sodium and potassium ions differs by not more than 20%, preferably by not more than 10%, from the total concentration of the lithium, sodium and potassium ions in component (K2a).

In one preferred embodiment of the kit of the invention or of a kit preferred in accordance with the invention, the concentration of the lithium ions in component (K2b) is lower than in component (K2a) and is preferably in the range from 0.1 to 5.0 mol/L, more preferably in the range from 0.1 to 2.0 mol/L.

Particularly preferred is a kit of the invention as described above (especially a kit referred to above or below as being preferred), at least comprising the following separate components:

(K1) an aqueous solution or dispersion comprising waterglass, where the $SiO_2$ content is in the range from 20 to 34 wt %, preferably in the range from 25 to 34 wt %, based on the total mass of the solution or dispersion, and/or where the molar $SiO_2/M_2O$ modulus is greater than the molar modulus of the lithium-containing waterglass under production, (K2a) a first waterglass-free solution or dispersion comprising lithium ions in solution in water, where the concentration of the lithium ions is in the range from 0.3 to 5.3 mol/L, preferably in the range from 1.0 to 5.0 mol/L and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and (K2b) a second waterglass-free solution or dispersion comprising lithium ions in solution in water, where the concentration of the lithium ions is lower than in component (K2a) and is preferably in the range from 0.1 to 5.0 mol/L, more preferably in the range from 0.1 to 2.0 mol/L, and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and preferably the total concentration of the lithium, sodium and potassium ions differs by not more than 20%, preferably by not more than 10%, from the total concentration of the lithium, sodium and potassium ions in component (K2a).

With regard to further preferred embodiments of a kit of the invention, the elucidations specified above for the method of the invention are valid correspondingly, and vice versa.

The above-specified kit of the invention is suitable and intended for use in the above-specified method of the invention.

The invention likewise relates to the use of an above-described kit of the invention or preferred kit of the invention for producing a molding material mixture or for producing a molding material mixture and a molding therefrom, where the molding material mixture comprises:

(M1) a mold base material and (M2) a solution or dispersion comprising lithium-containing waterglass, which possesses a molar $SiO_2/M_2O$ modulus in the range from 1.6 to 3.5, preferably in the range from 1.8 to 3.0, and in which the molar fraction of the Li2O within $M_2O$ is in the range from 0.05 to 0.60, preferably in the range from 0.1 to 0.4.

With regard to preferred embodiments of a use according to the invention, the elucidations specified above for the method of the invention and for the kit of the invention are valid correspondingly.

The invention, furthermore, also relates to an installation for use in the production of a molding material mixture or for producing a molding material mixture and a molding therefrom (preferably for use in the production according to a method of the invention), preferably for producing an intermediate solution or dispersion comprising lithium-containing waterglass for use in the production of a molding material mixture or for producing a molding material mixture and a molding therefrom, where the installation at least comprises:

a first storage tank (Z1), containing as first component an aqueous solution or dispersion (K1) comprising waterglass, where the $SiO_2$ content is in the range from 20 to 34 wt %, preferably in the range from 25 to 34 wt %, based on the total mass of the solution or dispersion, and/or where the molar $SiO_2/M_2O$ modulus is greater than the molar modulus of the lithium-containing waterglass in the molding material mixture under production, a second storage tank (Z2), containing as second component a first waterglass-free solution or dispersion (K2a), comprising lithium ions in solution in water, where the concentration of the lithium ions is in the range from 0.3 to 5.3 mol/L, preferably in the range from 1.0 to 5.0 mol/L and the total concentration of the lithium, sodium and potassium ions is in the range from 0.3 to 28.0 mol/L, preferably in the range from 0.3 to 20.0 mol/L, more preferably in the range from 1.0 to 10.0 mol/L, preferably a mixing facility (Z3), more preferably a mixing pipe, very preferably a static mixing pipe, for mixing at least the first and the second components to produce the or an intermediate solution or dispersion (with reference to the method of the invention, this intermediate solution or dispersion is identified as (M2)), and where preferably at least the first and the second storage tanks are connected to the mixing facility (Z3) in each case by one or more lines (Z4), where $M_2O$ denotes in each case the total amount of lithium oxide, sodium oxide and potassium oxide, and/or where the lithium-containing waterglass in the intermediate solution or dispersion possesses a molar $SiO_2/M_2O$ modulus in the range from 1.6 to 3.5, preferably in the range from 1.8 to 3.0, and/or in which the molar fraction of the $Li_2O$ within $M_2O$ is in the range from 0.05 to 0.60, preferably in the range from 0.1 to 0.4, where $M_2O$ denotes in each case the total amount of lithium oxide, sodium oxide and potassium oxide, and/or where the use takes place in a method of the invention as described above (especially a method referred to above or below as being preferred).

The installation of the invention preferably comprises a mixing facility (Z3), and preferably at least the first and the second storage tank are connected to the mixing facility (Z3) in each case by one or more lines (Z4). In this preferred embodiment, the installation of the invention is an installation for producing an intermediate solution or dispersion comprising lithium-containing waterglass (with respect to the method of the invention, this intermediate solution or dispersion is referred to as (M2)) for use in the production of a molding material mixture or for producing a molding material mixture and a molding therefrom.

The invention, however, also embraces an installation as described above which manages without a mixing facility, and in which components (K1), (K2a) and—where present and used—(K2b) are passed directly into the mold base material (M1), and only there are mixed with one another and with the mold base material (M1).

The mixing facility (Z3) may at the same time be a storage tank ((Z1), (Z2) or (Z5); see below). The content of the storage tank or tanks may be conveyed to the mixing facility by means of one or more pumps. Components (K1), (K2a) and (K2b) may also be premixed in only one of the storage tanks provided, and may be mixed subsequently with the mold base material. It is also possible for only components (K1) to be premixed with (K2a) or optionally (K1) with (K2b) or (K2a) with (K2b) in a storage tank, and only then mixed with the respective third component ((K2b) or (K2a) or (K1), respectively). It is also possible for each of components (K1), (K2a) and (K2b) to be mixed directly with the mold base material, without mixing with any of the other components.

With regard to preferred embodiments of an installation of the invention, the elucidations specified above for the method of the invention, for the kit of the invention and for the use according to the invention are valid correspondingly, and vice versa.

The installation of the invention as specified above or below is suitable and intended for use in the above-specified method of the invention.

The kit of the invention as specified above is suitable and intended for use in the installation specified above or below.

Also preferred, furthermore, is an installation of the invention as described above, further comprising a third storage tank (Z5), containing a second waterglass-free solution or dispersion (K2b) comprising alkali metal ions in solution in water, where the concentration of the lithium ions is lower than in component (K2a) and is preferably in the range from 0 to 5.0 mol/L, more preferably in the range from 0 to 2.0 mol/L, and the total concentration of the lithium, sodium and potassium ions is in the range from 0.3 to 28.0 mol/L, preferably in the range from 0.3 to 20.0 mol/L, more preferably in the range from 1.0 to 10.0 mol/L, and preferably the total concentration of the lithium, sodium and potassium ions differs by not more than 20%, preferably by not more than 10%, from the total concentration of the lithium, sodium and potassium ions in component (K2a), where preferably the mixing facility (Z3) is embodied for mixing at least the first, second and third components, to produce the intermediate solution or dispersion, and where preferably at least the first, the second and the third storage tank are connected to the mixing facility (Z3) in each case by one or more lines (Z4).

In one preferred embodiment of the installation of the invention or of an installation preferred in accordance with the invention, the concentration of the lithium ions in component (K2b) in the third storage tank (Z5) is lower than in component (K2a) and is preferably in the range from 0.1 to 5.0 mol/L, more preferably in the range from 0.1 to 2.0 mol/L.

The invention is described in more detail below, in the examples specified hereinafter, and with reference to the figures.

FIGURES

FIG. 1 shows a schematic construction of a detail of an installation of the invention with the following installation components: a first storage tank (Z1), a second storage tank (Z2), a mixing facility (Z3), and one or more (here: a plurality of) lines (Z4) which connect the first and second storage tanks to the mixing facility.

Figure 2:
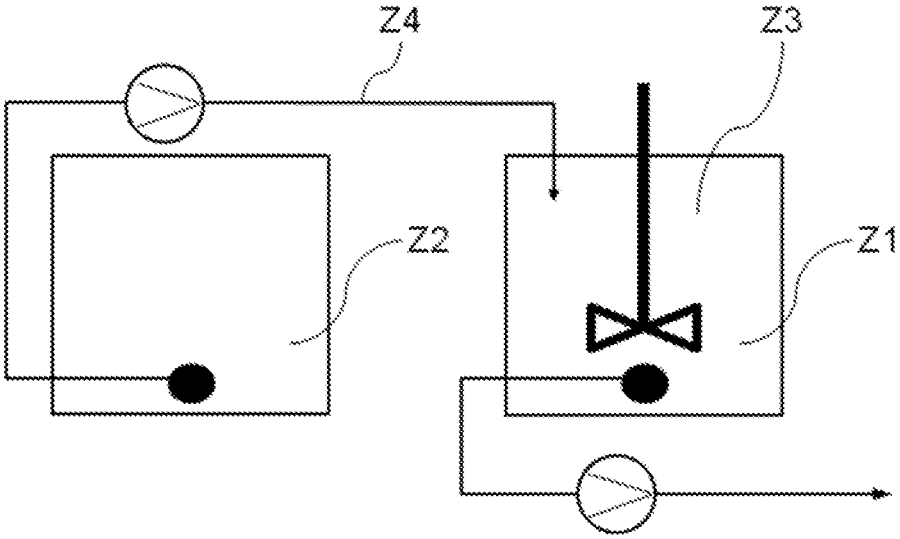

FIG. 2 shows a schematic construction of a detail of an installation of the invention with the following installation components: a first storage tank (Z1), a second storage tank (Z2), a mixing facility (Z3) (here identical with the first storage tank (Z1)), and one or more (here: one) lines (Z4) which connect the first and second storage tanks to the mixing facility (the first storage tank and the mixing facility being identical).

Figure 3:
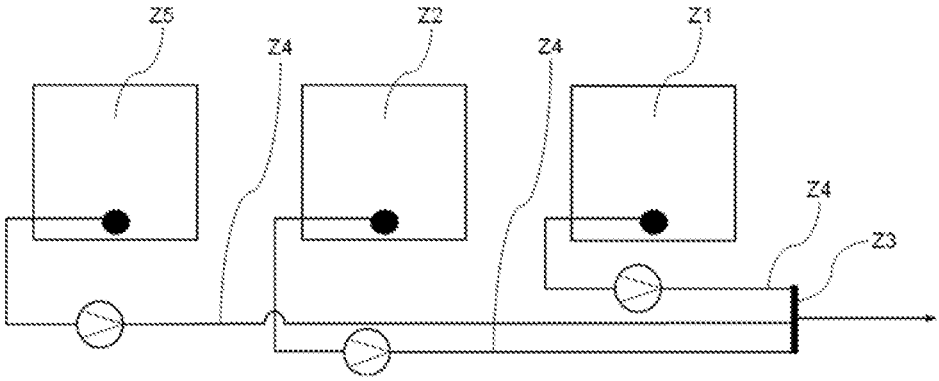

FIG. 3 shows a schematic construction of a detail of an installation of the invention with the following installation components: a first storage tank (Z1), a second storage tank (Z2), a third storage tank (Z5), a mixing facility (Z3) and one or more (here: a plurality of) lines (Z4) which connect the first, second and third storage tanks to the mixing facility.

EXAMPLES

The examples are intended to describe in more detail and explain the invention without limiting its scope of protection.

Unless otherwise specified, work was carried out under customary laboratory conditions (25° C., standard pressure).

Example 1a

Exemplary Components (K1), (K2a) and (K2b)

Exemplary components (K1), (K2a) and (K2b) were produced in a conventional way, having the properties shown in table 1a.

TABLE 1a

Exemplary components (K1), (K2a) and (K2b)

| Constituent | Component (K1) | Component (K2a) | Component (K2b) |
|---|---|---|---|
| Molar $SiO_2/M_2O$ modulus | 2.7 | n.s. | n.s. |
| Solids content [wt %] | 41 | 14 | 22 |
| $SiO_2$ content [wt %] | 29 | 0 | 0 |
| c ($Li^+$) [mol/L] | 0 | 2.4 | 0.3 |
| c ($Li^+/Na^+/K^+$) [mol/L] | n.s. | 3.0 | 3.0 |

In table 1a, "c ($Li^+$)" denotes the concentration of the lithium ions, and "c ($Li^+/Na^+/K^+$)" denotes the total concentration of lithium, sodium and potassium ions. "n.s." means that no value is stated in the cell in question. The figures for "wt %" are based in each case on the total mass of the corresponding component (K1), (K2a) or (K2b).

Example 1b

Determination of the pH in Components (K1), (K2a) and (K2b)

Preferred components (K1), (K2a) and (K2b) were produced in a conventional way. The pH values of the preferred components were subsequently determined in a conventional way. The results are reported below in table 1b:

TABLE 1b pH values of preferred components (K1), (K2a) and (K2b)

| Constituent | Component (K1) | Component (K2a) | Component (K2b) |
|---|---|---|---|
| pH | 11.6 | 12.0 | 13.5 |

The other properties of the preferred components (K1), (K2a) and (K2b) are very similar to those from table 1a; there are no significant deviations.

Example 2

Production of Inventive Solutions or Dispersions Comprising Lithium-Containing Waterglass Exemplary solutions or dispersions (M2) comprising lithium-containing waterglass are produced in accordance with the method of the invention, by conventional mixing of components (K1), (K2a) and optionally (K2b) with one another. The components used are in each case those specified in example 1. For this purpose, the respective fraction of component (K1) is introduced initially and the respective fraction of components (K2a) and optionally (K2b) is added. By shaking or stirring, the resulting solutions or dispersions (M2) are homogenized. The results are reported in table 2.

TABLE 2

Composition of inventively produced solutions or dispersions (M2) comprising lithium-containing waterglass

| Composition (M2) | Molar $SiO_2/M_2O$ modulus | Solids content [wt %] | $SiO_2$ content [wt %] | Molar fraction of $Li_2O$ within $M_2O$ |
|---|---|---|---|---|
| Experiment 1: (K1): 90 wt % (K2a): 10 wt % | 2.3 | 38 | 26 | 0.11 |
| Experiment 2: (K1): 90 wt % (K2a): 6 wt % (K2b): 4 wt % | 2.3 | 39 | 26 | 0.07 |
| Experiment 3: (K1): 85 wt % (K2a): 10 wt % (K2b): 5 wt % | 2.2 | 37 | 25 | 0.11 |
| Experiment 4: (K1): 85 wt % (K2a): 13 wt % (K2b): 2 wt % | 2.2 | 37 | 25 | 0.14 |

Example 3

Production of Molding Material Mixtures

From the constituents indicated in table 4, molding material mixtures were produced by the method of the invention (molding material mixtures EF1 to EF3) and also by a conventional, noninventive method a comparative molding material mixture (VF1) was produced, in accordance with the protocol indicated below. All quantities in table 4 are reported in parts by weight.

The "Binders" used (cf. table 4) comprise the inventive solutions or dispersions comprising lithium-containing waterglass (M2), produced according to table 3, and, respectively, the noninventive solution or dispersion (M2v) (cf. binders EL1 to EL3 and VL1). The "Mold base material" (M1) used in each case was silica sand (H31 from Quarzwerke GmbH, Frechen). The "Additive" used in each case was the commercial additive in powder form for foundry moldings, Anorgit® 8610 (from Hüttenes-Albertus Chemische Werke Gesellschaft mit beschränkter Haftung) whose constituents include particulate amorphous silicon dioxide.

TABLE 3

Composition of inventive solutions or dispersions (M2) and also comparative solution (M2v) produced

| Composition (M2) or (M2v) | Molar $SiO_2/M_2O$ modulus | Solids content [wt %] | $SiO_2$ content [wt %] | Molar fraction of $Li_2O$ within $M_2O$ |
|---|---|---|---|---|
| EL1 (M2) | 2.3 | 38 | 26 | 0.06 |
| EL2 (M2) | 2.2 | 38 | 26 | 0.08 |
| EL3 (M2) | 2.3 | 38 | 26 | 0.12 |
| VL1 (M2v) | 2.4 | 37 | 26 | 0 |

TABLE 4

Composition of the molding material mixtures

| Experiment | Mold base material [parts by weight] | Binder/ [parts by weight] | Additive [parts by weight] |
|---|---|---|---|
| EF1 | 100 | EL1/(2.2) | 1.3 |
| EF2 | 100 | EL2/(2.2) | 1.3 |
| EF3 | 100 | EL3/(2.2) | 1.3 |
| VF1 | 100 | VL1/(2.2) | 1.3 |

The constituents of the molding material mixture were mixed in a laboratory paddle mixer (from Multiserw). For this purpose, the silica sand was introduced initially, and the additive in powder form was mixed in. Thereafter the premixed binder (cf. table 3) was added. The mixture was subsequently stirred for a total of two minutes. The resulting molding material mixtures were then each used for the investigations below.

Example 4

Production of Moldings

The molding material mixtures (cf. table 4) produced in example 3 were used to produce, with the aid of a heatable mold for production of flexural specimens (as indicated in the March 1974 M11 Merkblatt of the Verein deutscher Gießereifachleute), moldings (test specimens, i.e., standard flexural bars with dimensions of 22.4 mm×22.4 mm×165 mm), which were used for the following experiments:

The molding material mixtures were each introduced by means of compressed air (4 bar) into the mold (core box temperature 180° C.). The injection time was 3 s, followed by a hardening time of 30 s (delay time 3 s). To accelerate the hardening of the mixtures, hot air (2 bar gassing pressure, 180° C. gassing and gassing-hose temperature) was passed through the mold during the 30 s hardening time.

The test specimens produced represent moldings and stand as models—as is usual in the field of art in question—of moldings which can be used in the foundry industry, such as molds or cores.

Example 5

Investigating the Storage Stability of Moldings

The storage stability of waterglass-bound moldings is dependent on the ambient conditions, particularly on the air humidity. The higher the humidity, the greater the risk of damage to the molding (e.g., core damage). Damage to the molding is manifested, for example, in component failure (e.g., core fracture) or in a sharp decrease in the strength (low residual strength, relative to the cold strength). In the case of high humidity, moreover, there is uptake of water, which on casting may lead to gas defects (e.g., gas bubbles in the casting).

The investigations took place under defined conditions (temperature and relative humidity), monitored in each case by means of a data logger. The moldings (test specimens) are each characterized in table 5 (see "Experiment" column) by the molding material mixtures used to produce them (see example 3 and table 3).

5.1. Determination of the Time to Component Failure

For determining the time to component failure (fracture of the test specimen), the test specimens were stored in a conditioned cabinet and the time to fracture was observed. The respective times in hours are reported in table 5, in each case as the average of three measurements.

5.2. Determination of the Residual Strength of Test Specimens

The residual strength was determined by storing the test specimens for defined durations (see table 5) in the conditioned cabinet. The flexural strengths were measured subsequently, directly after removal from the conditioned cabinet.

The flexural strengths were determined by placing the test specimens produced in example 4 into a Georg-Fischer strength tester, equipped with a 3-point bending apparatus (from Multiserw), and the force leading to the fracture of the test specimens was measured. The flexural strengths were measured after the durations indicated in table 5. The moldings (test specimens) are each characterized in table 5 (see "Experiment" column) by the molding material mixtures used to produce them (see example 3 and table 4).

The measurement values obtained (residual strengths expressed in % of the original value) are reported in table 5 as the average of three measurements in each case.

5.3. Determination of the Water Absorption of Test Specimens

To determine the water absorption, the test specimens were weighed one hour after removal from the mold, and then stored in the conditioned cabinet for a defined time (see table 5). The test specimens were weighed again directly after removal from the conditioned cabinet. The resulting differences in weight (or differences in mass) in % are reported in table 5 as the average of three measurements.

TABLE 5

Storage stability of moldings

| Experiment (Test specimen) | Time to component failure [h] 35° C., 79% rh, (31.3 g/m³) | Time to component failure [h] 35° C., 90% rh, (35.7 g/m³) | Residual strength at 35° C., 79% rh, (31.3 g/m³)/[%] After 4 h | Residual strength at 35° C., 79% rh, (31.3 g/m³)/[%] After 7 h | Water absorption after 24 h [%] 25° C., 64% rh, (14.7 g/m³) | Water absorption after 24 h [%] 35° C., 63% rh, (25.0 g/m³) |
|---|---|---|---|---|---|---|
| EF1 | 12.9 | 5.8 | 66 | 39 | n.d. | n.d. |
| EF2 | 18.5 | 7.4 | 72 | 49 | 0.12 | 0.14 |
| EF3 | 25.8 | 9.4 | 78 | 68 | 0.08 | 0.12 |
| VF1 | 6.4 | 2.9 | 30 | 0 | 0.21 | 0.22 |

In table 5, the "rh" means the relative humidity and the "n.d." means "not determined" (i.e., no measurement value was determined). The figures "31.3 g/m³", "35.3 g/m³", "14.7 g/m³" and "25.0 g/m³" indicate the absolute humidity in each case.

From the measurement values reported in table 5 it is apparent that the moldings produced by a method of the invention with lithium-containing waterglass (test specimens EF1, EF2 and EF3) exhibit better storage stabilities than a comparative test specimen (VF1) produced by a noninventive method (without addition of lithium). Moldings produced in accordance with the invention showed better storage capability (see table 5, column "Time to component failure"), greater residual strength after storage (see table 5, column "Residual strength at 35° C.") and lower water absorption (see table 5, column "Water absorption") than a comparative molding not produced in accordance with the invention.

It is further apparent from table 5 that as the lithium ion content of the solutions or dispersions (M2) used for producing the moldings increases within the stated range, there was an improvement in the observed properties of storage stability (higher), residual strength (higher) and water absorption (lower) of the moldings. A higher water absorption on the part of the molding has the general effect of increasing the risk of evolution of gas during the casting operation and hence of a reduced quality to the casting as a result of the inclusion of gas bubbles.

The conclusion that can be made from these observations is that, depending on the respectively prevailing climatic conditions (especially ambient temperature and relative and/or absolute humidity), at the location of use of the method of the invention and/or of the kit of the invention and/or of the installation of the invention, a correspondingly flexibly adjustable lithium ion concentration in a solution or dispersion (M2) to be prepared (as possible with the method of the invention and/or with the kit of the invention) is advantageous, since it allows the desired properties of moldings, especially the desired storage properties of moldings bound with binders, to be established and/or controlled in a targeted way:

Where, for example, the relevant climatic conditions do not require this, i.e., in so far as less demanding relevant climatic conditions prevail, especially a relatively low humidity, it is possible to lower the lithium ion content in the solution or dispersion (M2), with a consequent saving in costs. This saving in costs has become even more significant in recent times because lithium compounds have become much more expensive, owing primarily to increased demand in the battery industry.

5.4. Effect of Duration of Storage of a Solution or Dispersion (M2) on the Storage Stability of Moldings Components (K1), (K2a) and (K2b) of a solution or dispersion (M2) were used and were mixed with one another, or with one another and with the mold base material (M1), in the ways indicated here below, and under otherwise constant conditions:

a) components (K1), (K2a) and (K2b) were mixed directly with the mold base material, without preliminary mixing.
b) components (K1), (K2a) and (K2b) were premixed and the premix was subsequently mixed directly with the mold base material.
c) components (K1), (K2a) and (K2b) were premixed and the premix was mixed one day after its production with the mold base material.
d) components (K1), (K2a) and (K2b) were premixed and the premix was mixed two days after its production with the mold base material.
e) components (K1), (K2a) and (K2b) were premixed and the premix was mixed three days after its production with the mold base material.

The molding material mixtures a) to e) obtained above were subsequently used to produce moldings (test specimens; see example 4) as indicated above, which were investigated for their storage stabilities ("time to component failure"; see example 5.1).

No significant differences were ascertained when measuring the storage stabilities of moldings (test specimens) produced by the method of the invention with the above-specified molding material mixtures a) to e).

From this result it is possible to conclude that the solutions or dispersions (M2) produced by the method of the invention can be stored for at least three days under the test conditions without any resultant quality impairments relevant to practice.

Example 6

Investigation of the Storage Stability of Solutions or Dispersions (M2)

Samples of the solution or dispersion (M2) produced in example 3, with the designation "EL3", were stored in closed containers under the conditions specified in table 6, and their quality and consistency at the times indicated in table 6 were determined in each case by inspection, with the results reported likewise in table 6:

TABLE 6

Storage stability of a solution or dispersion (M2)

| Temperature [° C.] | 1 day | 1.5 days | 3 days | 6 days | 8 days |
|---|---|---|---|---|---|
| 20 | ++ | ++ | ++ | + | ○ |
| 25 | ++ | ++ | ++ | + | ○ |
| 30 | ++ | ++ | + | ○ | ○ |
| 50 | ++ | + | ○ | − | − |

In table 6, the symbols have the following meanings—"++": no ascertainable change in the solution or dispersion (M2); "+": slight change ascertainable in the solution or dispersion (M2), no adverse effect on quality; "o": slight gelling detectable, solution or dispersion (M2) still suitable for use without adverse effect; "−": severe precipitation apparent, solution or dispersion (M2) no longer suitable for use without adverse effect (e.g., in pumps, filters, metering units).

From the results above it is evident that a solution or dispersion (M2) produced by the method of the invention, even under adverse storage conditions, could be used for up to 8 days (preferably up to 7 days) without deterioration in quality to an extent relevant for practice, for producing moldings for the foundry industry.

As is likewise evident from table 6, solutions or dispersions (M2) produced with an advantageous (high) lithium content can therefore be stored and used in industrial practice in premixed form in the short term or at best medium term. For long-term storage (over several weeks, for instance), homogeneous (e.g., premixed) solutions or dispersions (M2) with an advantageous (high) lithium content are not suitable, however, for the reasons given before.

In accordance with the subject matter of the present invention, therefore, solutions or dispersions (M2) of this kind with an advantageous (high) lithium content ought not to be mixed until a short time or medium-term time before their actual industrial deployment, by mixing of separately stored components (K1), (K2a) and optionally (K2b) with one another, or with a mold base material, to give a molding material mixture.

The invention claimed is:

1. A method for producing a molding material mixture or for producing a molding material mixture and a molding therefrom, where the molding material mixture comprises:

(M1) a mold base material, and (M2) a solution or dispersion comprising lithium-containing waterglass, which possesses a molar $SiO_2/M_2O$ modulus in the range from 1.6 to 3.5, and in which the molar fraction of the $Li_2O$ within $M_2O$ is in the range from 0.05 to 0.60, comprising the following steps:

(1) producing or providing a kit at least comprising the following separate components:

(K1) an aqueous solution or dispersion comprising waterglass, where the $SiO_2$ content is in the range from 20 to 34 wt %, based on the total mass of the solution or dispersion, and/or where a molar $SiO_2/M_2O$ modulus is greater than the molar modulus of the lithium-containing waterglass in the molding material mixture being produced, and (K2a) a first waterglass-free solution or dispersion comprising lithium ions in solution in water, where a concentration of the lithium ions is in the range from 0.3 to 5.3 mol/L and a total concentration of the lithium, sodium and potassium ions is in the range from 0.3 to 28.0 mol/L, where $M_2O$ denotes in each case the total amount of lithium oxide, sodium oxide, and potassium oxide.

2. The method as claimed in claim 1 for producing a molding material mixture and a molding therefrom, wherein the kit produced or provided in step (1) additionally comprises the following separate component:

($K_2b$) a second waterglass-free solution or dispersion comprising alkali metal ions in solution in water, where the concentration of the lithium ions is lower than in component (K2a), and the total concentration of the lithium, sodium and potassium ions is in the range from 0.3 to 28.0 mol/L, and wherein step (2) comprises the following:

(2) producing a mixture of the mold base material (M1) with a fraction of component (K1) and also with a fraction of component (K2a) and optionally a fraction of component (K2b), where the solution or dispersion (M2) is formed by mixing together the components of the kit that are used.

3. The method as claimed in claim 1 for producing a molding material mixture and a molding therefrom, comprising the additional steps of establishing, determining or estimating one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, and controlling the fractions to be used of components (K2a) and (K2b) as a function of the established, determined or estimated parameter or parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, and/or where the method is embodied as at least partial serial fabrication of a number of moldings, where, in the case of increase or expected increase in one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, the fractions that are used of component (K2a) are increased for the fabrication of the moldings and/or the molar fraction of the $Li_2O$ within $M_2O$ in the solution or dispersion (M2) is increased for the fabrication of the moldings.

4. The method as claimed in claim 1, where the molding material mixture comprises:

(M1) the mold base material, and (M2) the solution or dispersion comprising lithium-containing waterglass, which possesses a molar $SiO_2/M_2O$ modulus in the range from 1.6 to 3.5, and in which the molar fraction of the $Li_2O$ within $M_2O$ is in the range from 0.05 to 0.60, comprising the following steps:

(1) producing or providing the kit at least comprising the following separate components:

(K1) the aqueous solution or dispersion comprising waterglass, where the $SiO_2$ content is in the range from 20 to 34 wt %, based on the total mass of the solution or dispersion, and/or where the molar $SiO_2/M_2O$ modulus is greater than the molar modulus of the lithium-containing waterglass in the molding material mixture being produced, (K2a) first waterglass-free solution or dispersion comprising lithium ions in solution in water, where the concentration of the lithium ions is in the range from 0.3 to 5.3 mol/L, and the total concentration of the lithium, sodium and potassium ions is in the range from 0.3 to 28.0 mol/L, and (K2b) a second waterglass-free solution or dispersion comprising lithium ions in solution in water, where the concentration of the lithium ions is lower than in component (K2a) and is in the range from 0.1 to 5.0 mol/L, and the total concentration of the lithium, sodium and potassium ions is in the range from 0.3 to 28.0 mol/L, and the total concentration of the lithium, sodium and potassium ions differs by not more than 20%, from the total concentration of the lithium, sodium and potassium ions in component (K2a), and thereafter (2) producing a mixture of the mold base material (M1) with a fraction of component (K1) and also with a fraction of component (K2a) and with a fraction of component (K2b), where the solution or dispersion (M2) is formed by mixing together the components of the kit that are used, where $M_2O$ denotes in each case the total amount of lithium oxide, sodium oxide and potassium oxide.

5. The method as claimed in claim 4, where, for establishing, determining or estimating the one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, a data capture facility or data processing facility is provided, and to control the fractions that are to be used of components (K2a) and (K2b) as a function of the established, determined or estimated parameter or parameters, a control facility is provided, where between the data capture facility or the data processing facility and the control facility, a data connection is set up to transfer parameter data.

6. The method as claimed in claim 2, where the aqueous solution or dispersion comprising waterglass (K1) has a pH in the range from 10.0 to 13.0, and/or the first waterglass-free solution or dispersion comprising lithium ions in solution in water (K2a) has a pH in the range from 8.0 to 14.0, and/or the second waterglass-free solution or dispersion comprising lithium ions in solution in water (K2b) has a pH in the range from 8.0 to 14.0.

7. The method as claimed in claim 1, where, during production of the molding material mixture, one or more constituents are additionally added which are selected from the group consisting of:

(M3) particulate, amorphous silicon dioxide; barium sulfate; carbohydrates; phosphorus compounds; surface-active compounds; oxidic boron compounds; metal oxides; lubricants, esters and release agents.

8. The method as claimed in claim 1, where the first waterglass-free solution or dispersion (K2a) and optionally the second waterglass-free solution or dispersion (K2b) in each case comprise lithium hydroxide in solution in water.

9. The method as claimed in claim 1, where in step (2) first, in the absence of the mold base material, a solution or dispersion (M2) is formed by mixing together the components of the kit that is used, and thereafter a mixture of the or a fraction of the mold base material (M1) with a fraction or the total amount of the resulting solution or dispersion (M2) is formed and/or where the solution or dispersion (M2) produced, before the forming of the mixture with the mold base material (M1), contains no visible precipitates or gel fractions.

10. The method as claimed in claim 9, where the components of the kit that are used are mixed together to form the solution or dispersion (M2) in a mixing facility, where the mixing facility is a metering vessel or a mixing pipe.

11. The method as claimed in claim 9, where the fraction or the total amount of the solution or dispersion (M2) formed, before the forming of a mixture with the or a fraction of the mold base material (M1), is stored for a period of not more than 7 days in the mixing facility.

12. The method as claimed in claim 1 for producing a molding material mixture and a molding therefrom, wherein the method further comprises:

(2) producing a mixture of the mold base material (M1) with a fraction of component (K1) and also with a fraction of component (K2a), where the solution or dispersion (M2) is formed by mixing together the components of the kit that are used, where $M_2O$ denotes in each case the total amount of lithium oxide, sodium oxide and potassium oxide.

13. The method as claimed in claim 12 for producing a molding material mixture and a molding therefrom, wherein the kit produced or provided in step (1) additionally comprises the following separate component:

(K2b) a second waterglass-free solution or dispersion comprising alkali metal ions in solution in water, where the concentration of the lithium ions is lower than in component (K2a), and the total concentration of the lithium, sodium and potassium ions is in the range from 0.3 to 28.0 mol/L, and wherein step (2) comprises the following:

(2) producing a mixture of the mold base material (M1) with a fraction of component (K1) and also with a fraction of component (K2a) and optionally a fraction of component (K2b), where the solution or dispersion (M2) is formed by mixing together the components of the kit that are used.

14. The method as claimed in claim 12, where the molding material mixture comprises:

(M1) a mold base material, and (M2) a solution or dispersion comprising lithium-containing waterglass, which possesses a molar $SiO_2/M_2O$ modulus in the range from 1.6 to 3.5, and in which the molar fraction of the $Li_2O$ within $M_2O$ is in the range from 0.05 to 0.60, comprising the following steps:

(1) producing or providing a kit at least comprising the following separate components:

(K1) an aqueous solution or dispersion comprising waterglass, where the $SiO_2$ content is in the range from 20 to 34 wt %, based on the total mass of the solution or dispersion, and/or where the molar $SiO_2/M_2O$ modulus is greater than the molar modulus of the lithium-containing waterglass in the molding material mixture being produced, (K2a) a first waterglass-free solution or dispersion comprising lithium ions in solution in water, where the concentration of the lithium ions is in the range from 0.3 to 5.3 mol/L, and the total concentration of the lithium, sodium and potassium ions is in the range from 0.3 to 28.0 mol/L, and (K2b) a second waterglass-free solution or dispersion comprising lithium ions in solution in water, where the concentration of the lithium ions is lower than in component (K2a) and is in the range from 0.1 to 5.0 mol/L, and the total concentration of the lithium, sodium and potassium ions is in the range from 0.3 to 28.0 mol/L, and the total concentration of the lithium, sodium and potassium ions differs by not more than 20%, from the total concentration of the lithium, sodium and potassium ions in component (K2a), and thereafter (2) producing a mixture of the mold base material (M1) with a fraction of component (K1) and also with a fraction of component (K2a) and with a fraction of component (K2b), where the solution or dispersion (M2) is formed by mixing together the components of the kit that are used, where $M_2O$ denotes in each case the total amount of lithium oxide, sodium oxide and potassium oxide.

15. The method as claimed in claim 12 for producing a molding material mixture and a molding therefrom, comprising the additional steps of establishing, determining or estimating one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, and controlling the fractions to be used of components (K2a) and (K2b) as a function of the established, determined or estimated parameter or parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, and/or where the method is embodied as at least partial serial fabrication of a number of moldings, where, in the case of increase or expected increase in one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, the fractions that are used of component (K2a) are increased for the fabrication of the moldings and/or the molar fraction of the $Li_2O$ within $M_2O$ in the solution or dispersion (M2) is increased for the fabrication of the moldings.

16. The method as claimed in claim 14, where, for establishing, determining or estimating the one or more parameters selected from the group consisting of ambient temperature during the production of the molding, relative humidity during the production of the molding, temperature during the storage of the molding, relative humidity during the storage of the molding, absolute humidity during the production of the molding, absolute humidity during the storage of the molding, and storage duration of the molding, a data capture facility or data processing facility is provided, and to control the fractions that are to be used of components (K2a) and (K2b) as a function of the established, determined or estimated parameter or parameters, a control facility is provided, where between the data capture facility or the data processing facility and the control facility, a data connection is set up to transfer parameter data.

17. The method as claimed in claim 12, where, during production of the molding material mixture, one or more constituents are additionally added which are selected from the group consisting of:

(M3) particulate, amorphous silicon dioxide; barium sulfate; carbohydrates; phosphorus compounds; surface-active compounds; oxidic boron compounds; metal oxides; lubricants, esters and release agents.

18. The method as claimed in claim 12, where the first waterglass-free solution or dispersion (K2a) and optionally the second waterglass-free solution or dispersion (K2b) in each case comprise lithium hydroxide in solution in water.

19. The method as claimed in claim 12, where in step (2) first, in the absence of the mold base material, a solution or dispersion (M2) is formed by mixing together the components of the kit that is used, and thereafter a mixture of the or a fraction of the mold base material (M1) with a fraction or the total amount of the resulting solution or dispersion (M2) is formed and/or where the solution or dispersion (M2) produced, before the forming of the mixture with the mold base material (M1), contains no visible precipitates or gel fractions.

20. The method as claimed in claim 19, where the components of the kit that are used are mixed together to form the solution or dispersion (M2) in a mixing facility, where the mixing facility is a metering vessel or a mixing pipe.

* * * * *